US008852499B2

(12) United States Patent
Schulz et al.

(10) Patent No.: US 8,852,499 B2
(45) Date of Patent: Oct. 7, 2014

(54) NANOCRYSTALLINE ALLOYS OF THE FE3AL(RU) TYPE AND USE THEREOF OPTIONALLY IN NANOCRYSTALLINE FORM FOR MAKING ELECTRODES FOR SODIUM CHLORATE SYNTHESIS

(75) Inventors: Robert Schulz, Ste-Julie (CA); Sylvio Savoie, Ste-Julie (CA)

(73) Assignees: Hydro-Québec, Montreal (CA); Meeir Technologie Inc., Candiac (CA)

( * ) Notice: Subject to any disclaimer, the term of this patent is extended or adjusted under 35 U.S.C. 154(b) by 715 days.

(21) Appl. No.: 12/599,856

(22) PCT Filed: May 15, 2008

(86) PCT No.: PCT/CA2008/000947

§ 371 (c)(1),
(2), (4) Date: Dec. 30, 2009

(87) PCT Pub. No.: WO2008/138148

PCT Pub. Date: Nov. 20, 2008

(65) Prior Publication Data

US 2010/0159152 A1 Jun. 24, 2010

(30) Foreign Application Priority Data

May 15, 2007 (CA) ..... 2588906

(51) Int. Cl.

| | |
|---|---|
| ***C22C 38/06*** | (2006.01) |
| ***C23C 30/00*** | (2006.01) |
| ***C23C 24/04*** | (2006.01) |
| ***C25B 1/26*** | (2006.01) |
| ***C22C 1/04*** | (2006.01) |
| ***C25B 11/04*** | (2006.01) |
| ***B22F 1/00*** | (2006.01) |
| ***C23C 4/08*** | (2006.01) |

(52) U.S. Cl.

CPC ..... *C23C 30/00* (2013.01); *C23C 24/04* (2013.01); *C22C 38/06* (2013.01); *C25B 1/265* (2013.01); *C22C 1/0491* (2013.01); *C25B 11/0452* (2013.01); *B22F 1/0044* (2013.01); *C23C 4/08* (2013.01)

USPC ..... 420/77; 148/320; 75/246; 75/352; 427/456

(58) Field of Classification Search

CPC C22C 38/06; C22C 2200/00; C22C 2200/02; C22C 2200/04; C22C 2200/06

USPC ..... 148/320, 333–336; 420/77–82, 420/103–116, 119, 900

See application file for complete search history.

(56) References Cited

U.S. PATENT DOCUMENTS

| | | | | |
|---|---|---|---|---|
| 5,034,273 | A * | 7/1991 | Sakakima et al. | 428/813 |
| 5,662,834 | A | 9/1997 | Schulz et al. | |
| 6,489,043 | B1 * | 12/2002 | Deevi et al. | 428/681 |
| 2002/0134468 | A1 * | 9/2002 | Reddy et al. | 148/306 |

FOREIGN PATENT DOCUMENTS

| | | | | |
|---|---|---|---|---|
| CA | 2154428 | A1 | 1/1997 | |
| CA | 2492128 | A1 | 7/2006 | |
| JP | 02-175169 | A * | 7/1990 | C01G 49/00 |
| JP | 2001-089833 | A * | 4/2001 | C22C 38/00 |

OTHER PUBLICATIONS

E. Bonetti et al., "A study of nanocrystalline iron and aluminide metals and Fe3Al intermetallic by mechanical alloying," Journal of Materials Science, 30 (1995), pp. 2220-2226.*

Zhu et al., "Microstructure and Mechanical Properties of Mechanically Alloyed and HIP-Consolidated Fe3Al," Materials Transactions, JIM, vol. 40, No. 12, (1999), pp. 1461-1466.*

M.-T. Perez-Prado and M.E. Kassner, Creep of Intermetallics (Ch. 9, pp. 185-220), Fundamentals of Creep in Metals and Alloys, Second edition, 2009.*

Written Opinion of the International Searching Authority, mailed Sep. 2, 2008; International Application No.: PCT/CA2008/000947.

* cited by examiner

*Primary Examiner* — Scott Kastler
*Assistant Examiner* — Vanessa Luk
(74) *Attorney, Agent, or Firm* — Fish & Richardson P.C.

(57) ABSTRACT

The invention concerns a nanocrystalline alloy of the formula:

$$Fe_{3-x}Al_{1+x}M_yT_z$$

wherein:

M represents at least one catalytic specie selected from the group consisting of Ru, Ir, Pd, Pt, Rh, Os, Re, Ag and Ni;

T represents at least one element selected from the group consisting of Mo, Co, Cr, V, Cu, Zn, Nb, W, Zr, Y, Mn, Cd, Si, B, C, O, N, P, F, S, Cl and Na;

x is a number larger than −1 and smaller than or equal to +1 y is a number larger than 0 and smaller or equal to +1 z is a number ranging between 0 and +1

The invention also concerns the use of this alloy in a nanocrystalline form or not for the fabrication of electrodes which in particular, can be used for the synthesis of sodium chlorate.

20 Claims, 15 Drawing Sheets

Average size and particle size distribution of $Fe_3AlRu_{0.1}$ as a function of milling time

| Time | <d> mean |
|---|---|
| 0h | 71,2 μm |
| 3h | 54,0 μm |
| 6h | 45,0 μm |
| 10h | 40,7 μm |
| 14h | 37,8 μm |

NANOCRYSTALLINE ALLOYS OF THE FE3AL(RU) TYPE AND USE THEREOF OPTIONALLY IN NANOCRYSTALLINE FORM FOR MAKING ELECTRODES FOR SODIUM CHLORATE SYNTHESIS

CROSS REFERENCE TO PRIOR APPLICATIONS

This is a U.S. National Phase application under 35 U.S.C. §371 of International Patent Application No. PCT/CA2008/000947, filed May 15, 2008, and claims the benefit of Canadian Patent Application No. 2588906, filed May 15, 2007 both of which are incorporated by reference herein. The International Application published on Nov. 20, 2008 as WO 2008/138148 under PCT Article 21(2).

FIELD OF INVENTION

The present invention relates to new nanocrystalline alloys based on Fe, Al and a catalytic element.

The present invention relates also to a method of fabrication of these new nanocrystalline alloys.

The present invention has also for object the use of these alloys in nanocrystalline form or not, to fabricate electrodes which in particular, can be used for the synthesis of sodium chlorate.

TECHNOLOGICAL BACKGROUND

Sodium chlorate ($NaClO_3$) is a paper bleaching agent used in the pulp and paper industry. It is less harmful to the environment than chlorine gas and as a result, its demand has increased significantly during the years. It is produced in electrolysis cells and the global chemical reaction is:

$$NaCl+3H_2O \rightarrow NaClO_3+3H_2$$

The voltage between the electrodes of the electrochemical cells is typically between 3.0 and 3.2 volts for a current density of 250 mA/cm$^2$. At the cathode where hydrogen is released, one often uses iron as electrode material. The cathodic overpotential for an iron electrode is about 900 mV. This high overpotential for the hydrogen evolution reaction constitutes the principal source of energy loss of the process of synthesis of sodium chlorate. In open circuit, the iron electrodes have also the tendency to corrode severely in the electrolyte therefore affecting their life span. For all of these reasons and considering the increase of energy costs, researchers have tried in the last few years to find substitutes for the iron electrode in order to improve the energy efficiency of cells for the synthesis of sodium chlorate.

One of these substitutes is described in the U.S. Pat. No. 5,662,834 and in the corresponding Canadian patent #2,154,428 who propose new alloys based on Ti, Ru, Fe and O and the electrode coatings based on these materials which allow to reduce the overpotential at the cathode by about 300 mV. However, these alloys are expensive because they require significant amounts of the catalytic species "ruthenium" (Ru) to be active. The international patent application PCT/CA2006/000003 and the corresponding Canadian application CA 2,492,128 try to solve this problem by proposing to replace part of the ruthenium by aluminum in materials similar to those of the patent U.S. Pat. No. 5,662,834 while preserving the beneficial catalytic properties. Therefore, these last patent applications propose alloys based on T, Ru, and Al with a reduced content of ruthenium which show cathodic overpotentials of about 600 mV similar to those of alloys based on Ti, Ru, Fe and O. These alloys have similar crystallographic structures of the cubic type β2 where the (000) site is occupied by Ti and the (½,½, ½) is occupied in one case, by a random mixture of Fe and Ru (U.S. Pat. No. 5,662,834) and in the other case, by a mixture of Al and Ru (PCT/CA2006/000003). The problem with these materials and this structure is that it absorbs hydrogen easily and this leads to its deterioration in time. Indeed, in order to reduce this hydrogen absorption tendency, it is necessary in all of these cases, to introduce oxygen or an element such as boron which makes the materials fragile and hard to fabricate as electrode coating. This tendency to absorb hydrogen is partly caused by the presence of Ti in the structure which forms strong chemical bonds with hydrogen. Therefore, it would be desirable to find a new structure without Ti which could host the catalytic specie, would not absorb hydrogen, and would show a low cathodic overpotential even when the catalytic specie is at low concentration.

SUMMARY OF THE INVENTION

It has been discovered in the framework of this invention that an iron aluminide of the type ($Fe_3Al$) could host within its structure significant amounts of Ru or other catalytic elements and the iron aluminide doped which such catalytic elements shows for the reaction of synthesis of sodium chlorate, a cathodic overpotential as low as if not lower than those of the materials previously described. Iron aluminide do not contain Ti and do not absorb a notable hydrogen quantity. Its crystalline structure is of the cubic type $DO_3$ in its ordered state.

The iron aluminide described in the present invention can be described by the following chemical formula on a range of concentration varying from x=−1 and x=+1

$$Fe_{3-x}Al_{1+x}$$

This material is very resistant to corrosion because of the presence of aluminum and is being considered as a potential substitute for stainless steel. The previous art mentions that it is possible to produce coatings of iron aluminide on iron substrates to protect them against corrosion or oxidation.

This invention has for first object a new nanocrystalline alloy characterized by the following formula:

$$Fe_{3-x}Al_{1+x}M_yT_z$$

in which:

- x is a number larger than −1 and smaller than or equal to +1, preferably between −0.5 and +0.5 and more preferably equal to 0;
- y is a number larger than 0 and smaller than or equal to +1; preferably between 0.05 and 0.6, and more preferably equal to 0.2;
- z is a number comprised between 0 and +1, preferably smaller than 0.5 and more preferably equal to 0;
- M represents one or several catalytic species selected from the group consisting of Ru, Ir, Pd, Pt, Rh, Os, Re, Ag and Ni, the element or elements being preferably Ru, Ir or Pd and
- T represents one or several elements selected from the group consisting of Mo, Co, Cr, V, Cu, Zn, Nb, W, Zr, Y, Mn, Cd, Si, B, C, O, N, P, F, S, Cl, and Na, the element or elements being preferably Mo, Co or Cr.

In the above formula, $Fe_{3-x}Al_{1+x}$ is the nanocrystalline matrix which allows to host within its structure, the element or elements M and T in substitution. M is the catalytic element or elements which provide the improved electro-catalytic properties to the matrix and in particular, the low cathodic overpotential with respect to the electro-chemical reaction of synthesis of sodium chlorate. T is the non-catalytic element or elements which provide to the material the expected good physicochemical properties such as a good mechanical strength, an improved corrosion resistance or advantages with respect to costs and fabrication.

By nanocrystalline state, we mean a microstructure constituted of crystallites whose sizes are smaller than 100 nm. The alloy is preferably a single phase with a cubic crystallographic structure of the type $Fe_3Al(Ru)$. However, the alloy according to the invention can be chemically ordered or disordered and topologically ordered or disordered. It can also be multiphase, in other words, made of several phases, the principal one being of the type $Fe_3Al(Ru)$.

The invention has for second object, a method of fabrication of a powder of the nanocrystalline alloy which consists of:

1) milling intensively a powder of iron aluminide of the type $Fe_3Al$ with a powder of one or several catalytic species M and one or several optional elements T for a time duration sufficient to introduce the elements within the crystalline structure of the iron aluminide; and
2) reducing the size of the crystals of the iron aluminide to the nanometric scale (<100 nm).

By intense milling, we mean a mechanical milling in a crucible with balls whose power is typically larger than 0.1 kW/liter.

The present invention has for third object, the use of an alloy of the type $Fe_3Al(Ru)$ not necessarily nanocrystalline even though it is preferable, for the fabrication of electrodes. This fabrication can be achieved by projecting on a substrate a powder of an alloy according to the invention with any one of the following techniques:

air plasma spray (APS)
vacuum plasma spray (VPS)
low pressure plasma spray (LPPS)
cold spray (CS); or
high velocity oxyfuel (HVOF)

This is of course done in order to produce a coating on the chosen substrate. The substrate is preferably an iron or a titanium plate.

These electrodes could also be fabricated by applying the alloy on a substrate by pressing, rolling, brazing or soldering either directly or with the help of a binder. This binder could be a metal additive, a polymer, a metallic foam, etc.

These electrodes thus fabricated could for instance be used for the electrochemical synthesis of sodium chlorate. As mentioned before, in this particular context, the alloy is not necessarily nanocrystalline even though it is preferable in order to achieve low overpotentials.

The invention and its associated advantages will be better understood upon reading the following more detailed but non limitative description of the preferred modes of achievement made with reference to the enclosed drawings.

DETAILED DESCRIPTION OF THE INVENTION

Figure 1:
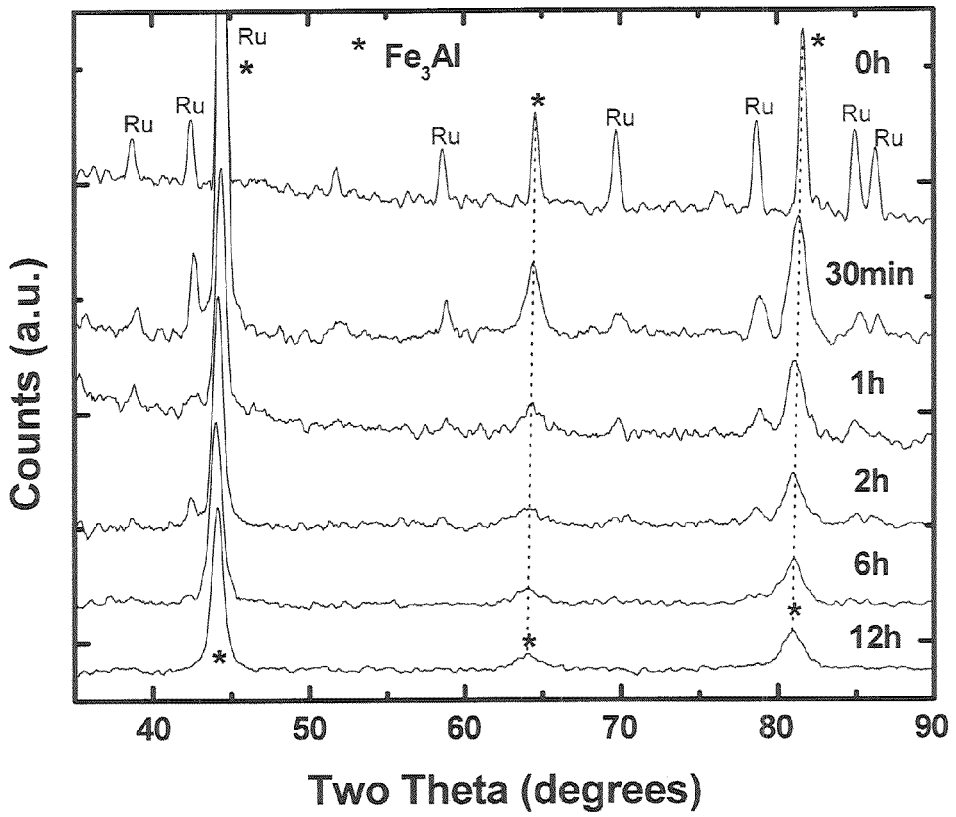
FIG. 1 represents X-ray diffraction spectra of a mixture of powders of iron aluminide (Fe3Al) and Ru in a molar proportion 1:0.25 as a function of the milling time.

As indicated previously, FIG. 1 represents X-ray diffraction spectra of a powder mixture of iron aluminide ($Fe_3Al$) and Ru in a molar proportion of 1:0.25 as a function of the intense mechanical milling time.

One can see in FIG. 1 that as the milling proceeds, the peaks of Ru disappear while the peaks of iron aluminide (represented by asterisks) become wider. Theses last peaks shift toward the small angles indicating that Ru is being inserted in the crystalline structure of iron aluminide and the crystal size of iron aluminide is being reduced to the nanometer scale.

Figure 2:
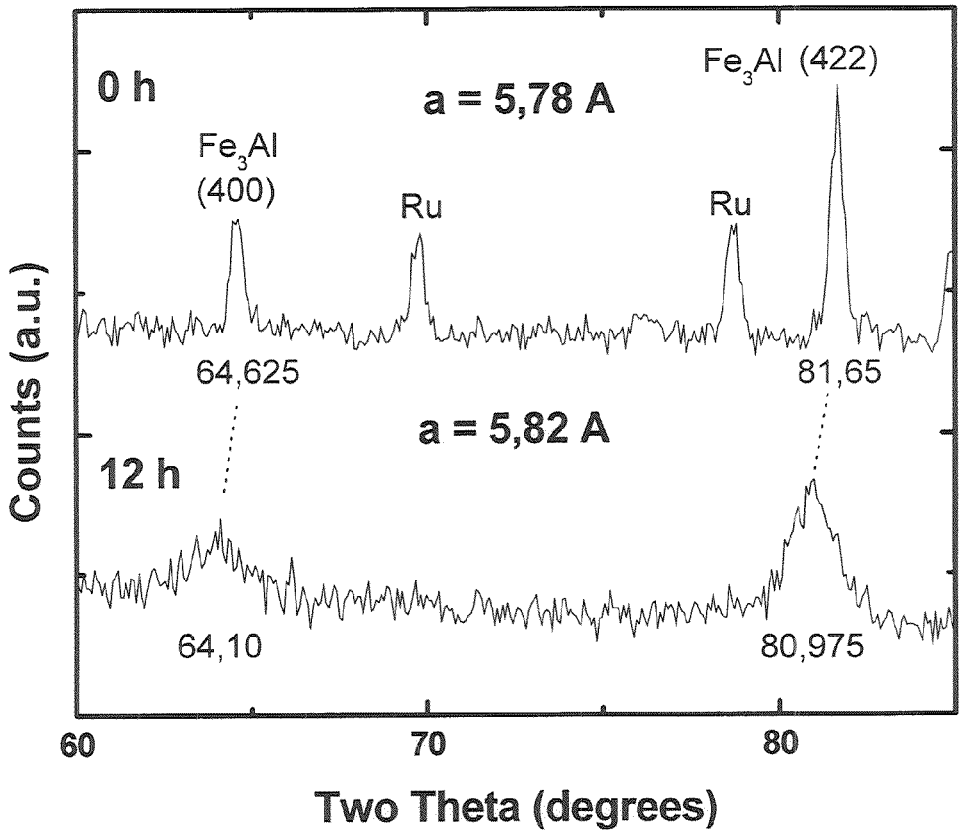
FIG. 2 represents a magnified view of the X-ray diffraction spectra of FIG. 1 corresponding to 0 h and 12 h of milling.

FIG. 2 represents a magnified view of the X-ray diffraction spectra of FIG. 1 corresponding to 0 h and 12 h of milling. As mentioned before, one clearly sees on FIG. 2 that after 12 h of milling, the Ru peaks have disappeared. Peaks (400) and (422) of iron aluminide have been displaced towards the left after 12 h indicating that the unit cell of iron aluminide has expanded due to the incorporation of Ru into the crystallographic structure.

Figure 3:
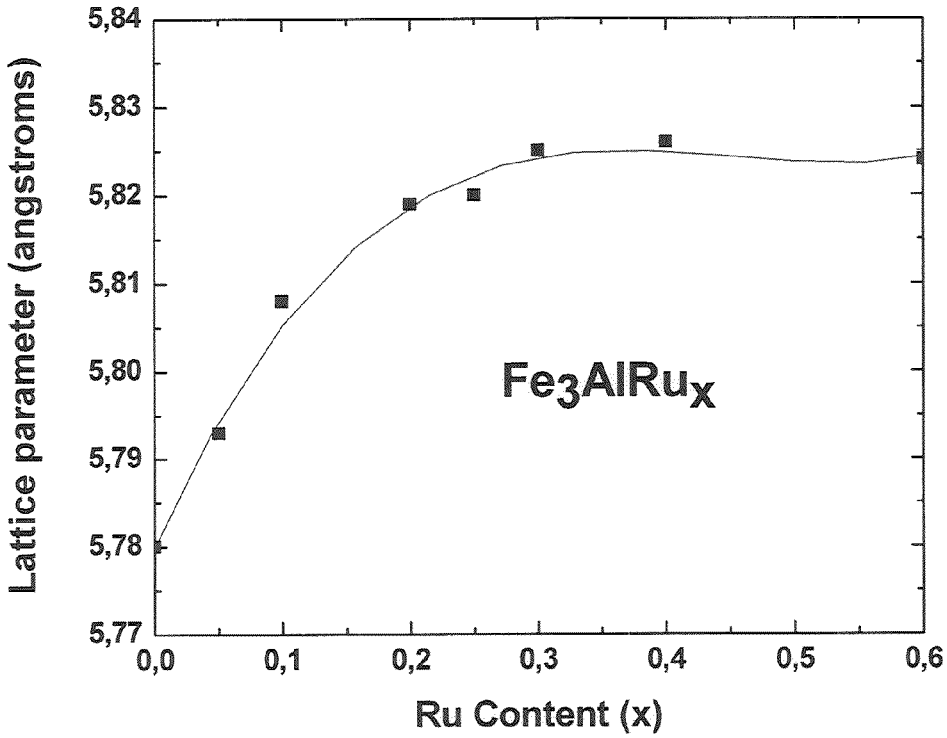
FIG. 3 represents the evolution of the lattice parameter of the iron aluminide with respect to the Ru content.

FIG. 3 represents the evolution of the lattice parameter of iron aluminide as a function of the Ru content. One sees also there, that the lattice parameter of iron aluminide doped with Ru ($Fe_3AlRu_x$) increases rapidly with the insertion of Ru between x=0 and x=0.3 and afterwards, between x=0.3 and x=0.6, the lattice parameter levels off at a value of about 5.825 angströms.

Figure 4:
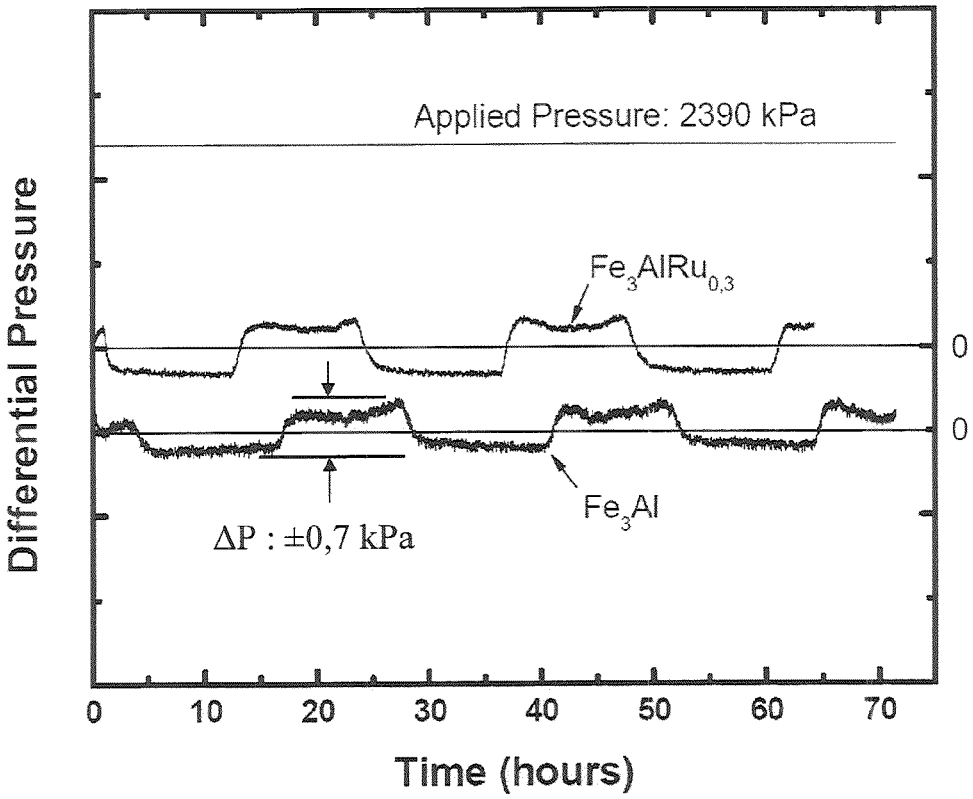
FIG. 4 represents measurements of hydrogen absorption at 80° C. in iron aluminide $Fe_3Al$ and in an alloy of the formula $Fe_3AlRu_{0.3}$ according to the invention as a function of the time of exposition to a hydrogen pressure of about 24 bars (2390 kPa).

FIG. 4 represents measurements of hydrogen absorption at 80° C. in iron aluminide ($Fe_3Al$) and in a catalyst of formula $Fe_3AlRu_{0.3}$ according to the invention as a function of the time of exposition to a hydrogen pressure of about 24 bars (2390 kPa). This FIG. 4 shows that the iron aluminide and the catalyst do not absorb any significant quantity of hydrogen. In this experiment, the materials have been exposed to a hydrogen pressure of 2390 kPa over a period of 70 hours at a temperature of 80° C. (a temperature near the one used in industrial electrolysis cells). The differential pressure gauge did not measure any hydrogen absorption over this period of time. The small oscillations of ±0.7 kPa with a period of 24 hours have been caused by the ambient temperature variations in the laboratory where the measurements were taken.

Figure 5:
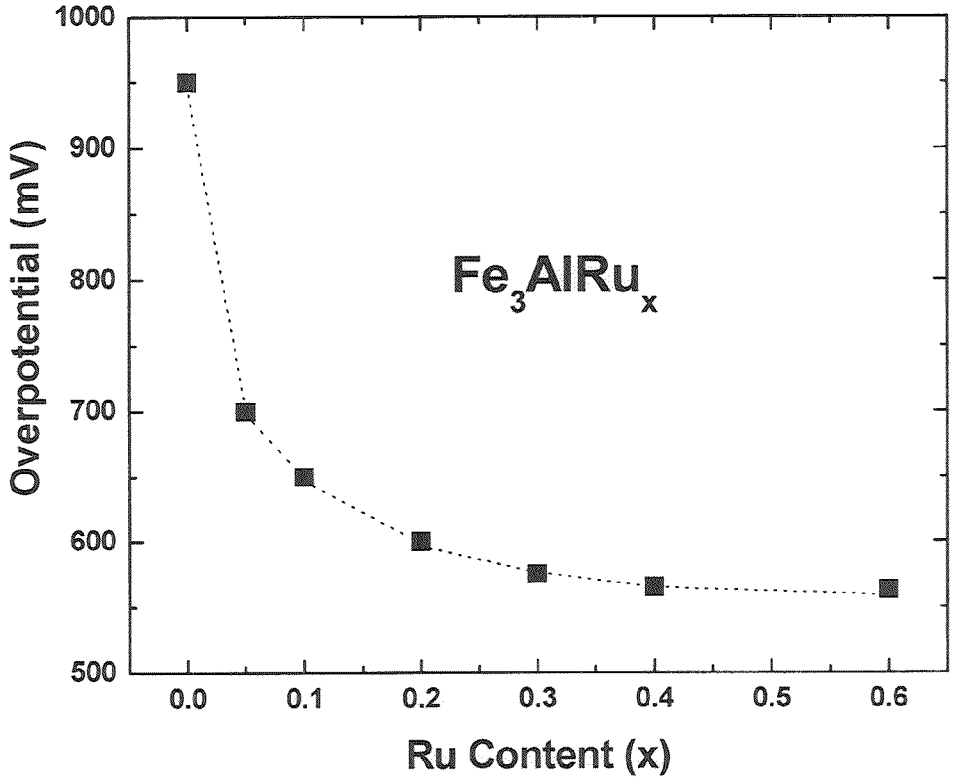
FIG. 5 represents cathodic overpotential values at 250 $mA/cm^2$ of an iron aluminide doped with Ru as a function of the Ru content.

FIG. 5 represents the cathodic overpotential values at 250 mA/cm$^2$ of an iron aluminide doped with Ru as a function of the Ru content. One sees on this figure that the iron aluminide without Ru (x=0) is not very active. Its overpotential value is about 950 mV. On the other end, one needs to add only 0.05 mole of Ru per mole of iron aluminide to lower this overpotential by 250 mV (that is from 950 mV to 700 mV). For Ru content larger than x=0.2, the drop in the overpotential is no longer significant and the further addition of Ru is not justified.

Figure 6:
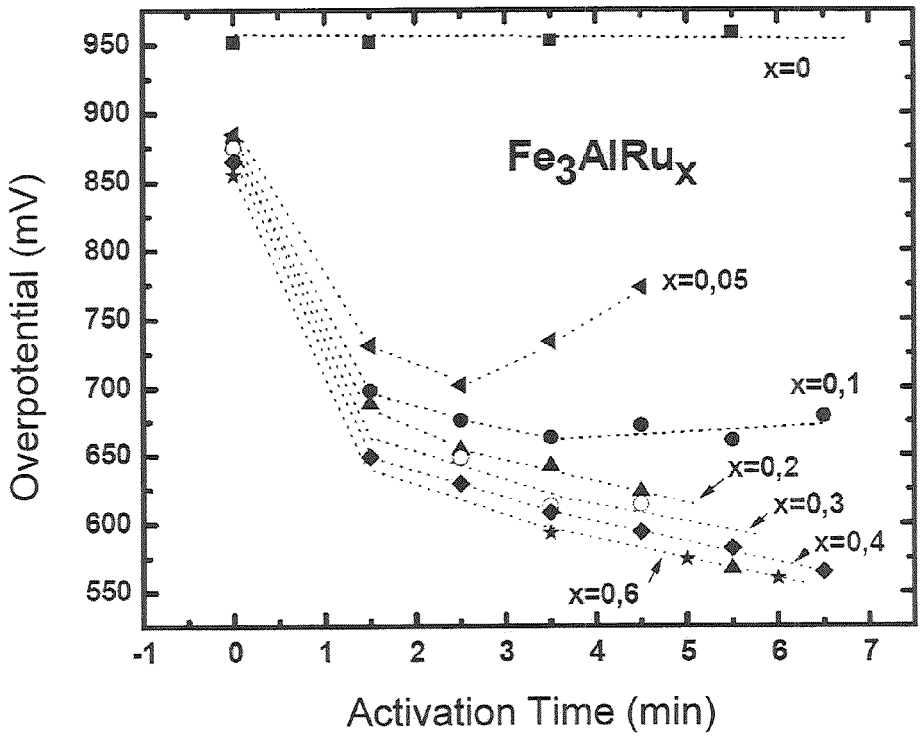
FIG. 6 represents the overpotential value of an alloy of formula $Fe_3AlRu_x$ as a function of the activation time in hydrochloric acid (HCl) for materials of the invention with various Ru content.

FIG. 6 represents the overpotential value of $Fe_3AlRu_x$ as a function of activation time in hydrochloric acid for materials of the invention with various Ru content. It is relevant to mention at this time that the materials prepared by intense milling are not very active right after milling because of the natural oxide on the surface. Therefore, we need to activate them by exposing their surfaces to an acid. For each Ru content, there is an optimum activation period for obtaining a minimum overpotential value. These minimum values of overpotential are depicted in FIG. 5.

Figure 7:
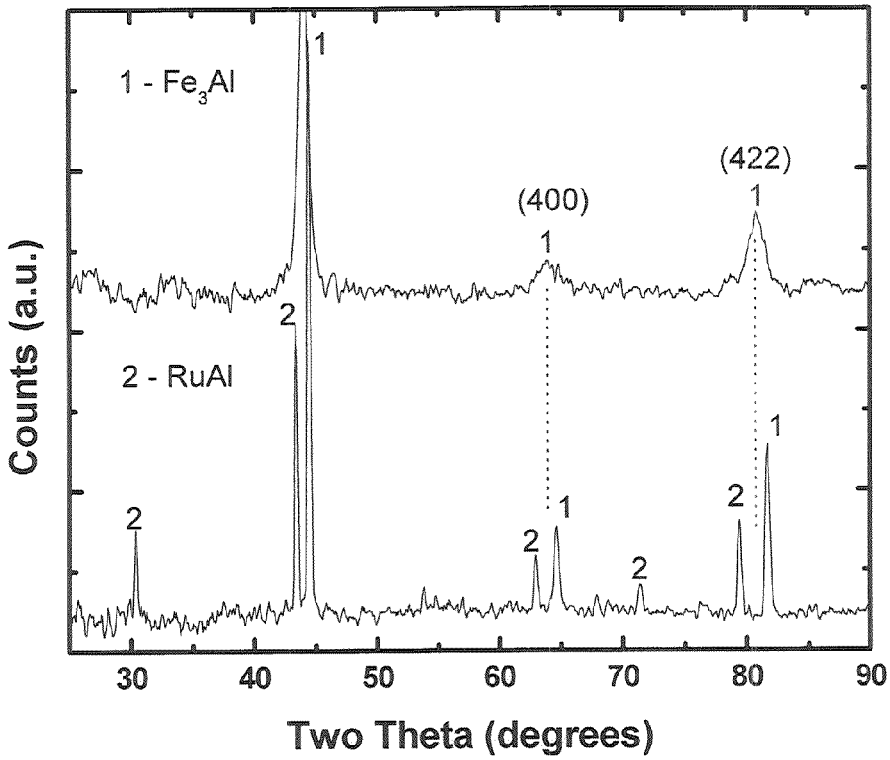
FIG. 7 represents X-ray diffraction spectra of an alloy of formula $Fe_3AlRu_{0.4}$ before (upper spectrum) and after (lower spectrum) heat treatment at high temperature.

FIG. 7 represents X-ray diffraction spectra of an alloy of formula $Fe_3AlRu_{0.4}$ before (upper spectrum) and after (lower spectrum) thermal treatment at high temperature. The upper spectrum is typical of a material according to the invention. One can observe peaks characteristic of iron aluminide shifted towards the left because of the insertion of Ru in the unit cell as mentioned previously. These peaks represented by the number 1 in the upper figure, are very wide and this is typical of a nanocrystalline structure (crystal size less than 100 nm). The cathodic overpotential for this nanocrystalline material is about 560 mV at 250 mA/cm$^2$. The lower spectrum shows what happen when a material is heated at 1000° C. The Ru is forced out of the unit cell of the iron aluminide and there is precipitation of the intermetallic compound RuAl represented by the number 2 on the lower figure.

The reaction which is taken place can be written in the following form:

$$Fe_3AlRu_{0.4} \rightarrow 0.4(RuAl)+Fe_{0.83}Al_{0.17}$$

Moreover, one sees, on the lower spectrum of FIG. 7, that the X-ray diffraction peaks are very narrow after thermal treatment indicating that the material has lost its nanocrystallinity. When this happens, the cathodic overpotential gets worst. The minimum overpotential value of the material which corresponds to the lower spectrum of FIG. 7 was 736 mV. These results show the importance of the nanocrystallinity and of the dispersion of the catalytic specie within the matrix of iron aluminide in order to obtain low overpotential values.

Figure 8A:
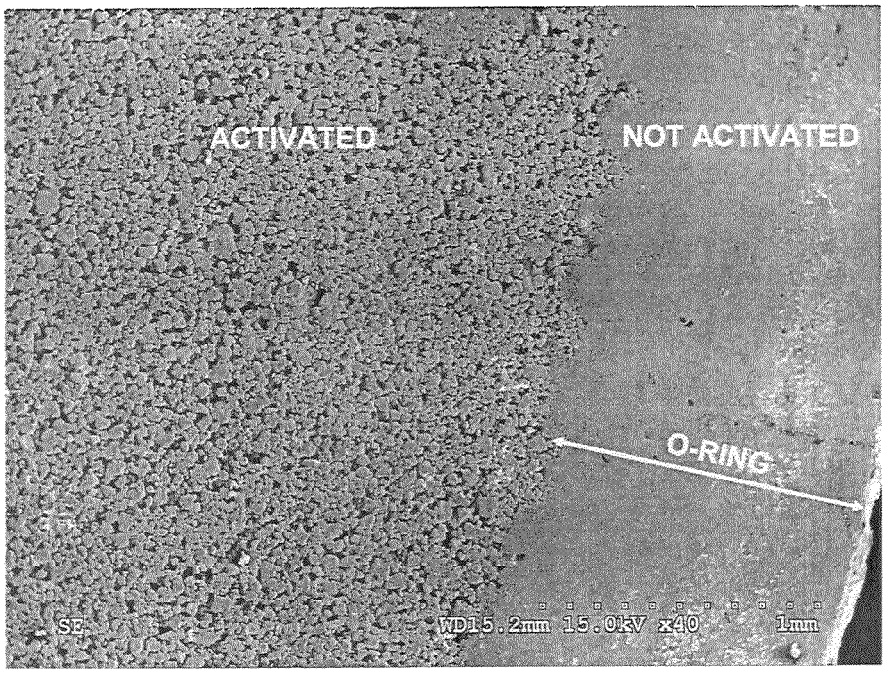
FIG. 8*a*) represents a micrograph taken with a scanning electron microscope of an electrode in the form of a pellet made from a pressed powder of formula $Fe_3AlRu_{0.1}$ according to the invention.
Figure 8B:
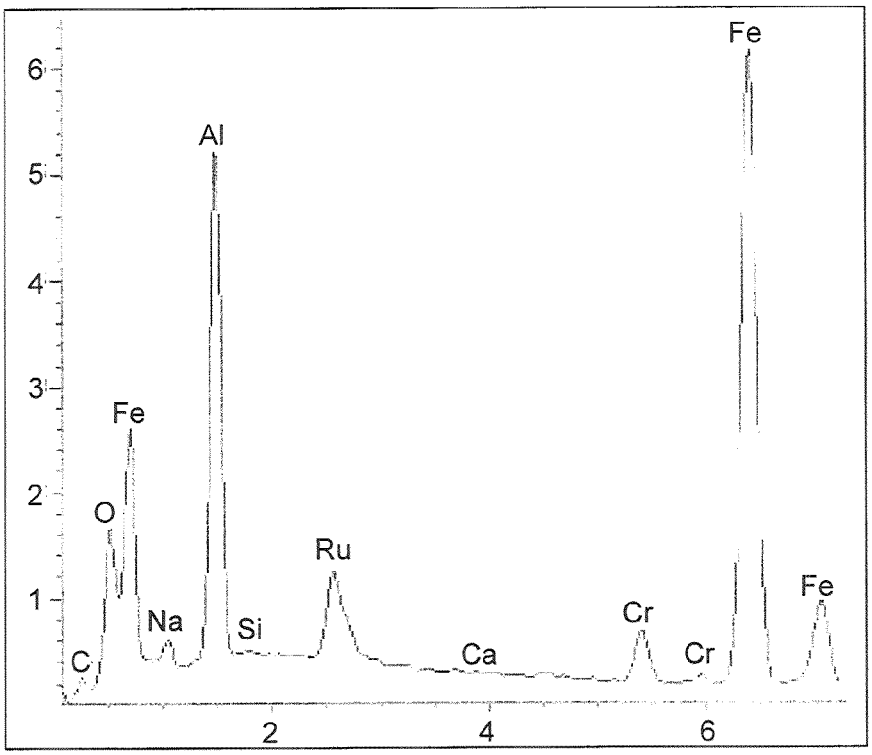
FIG. 8*b*) shows the EDX spectrum of an alloy of formula $Fe_3AlRu_{0.1}$.

FIG. 8*a*) represents a micrograph taken on a scanning electron microscope of an electrode in the form of a pellet made from pressed powder according to the invention. FIG. 8*b*) shows an EDX spectrum of the alloy of formula $Fe_3AlRu_{0.1}$. One sees on this figure the characteristic peaks of Fe, Al, and Ru but also of Na and Cr coming from the electrolyte.

Figure 9A:
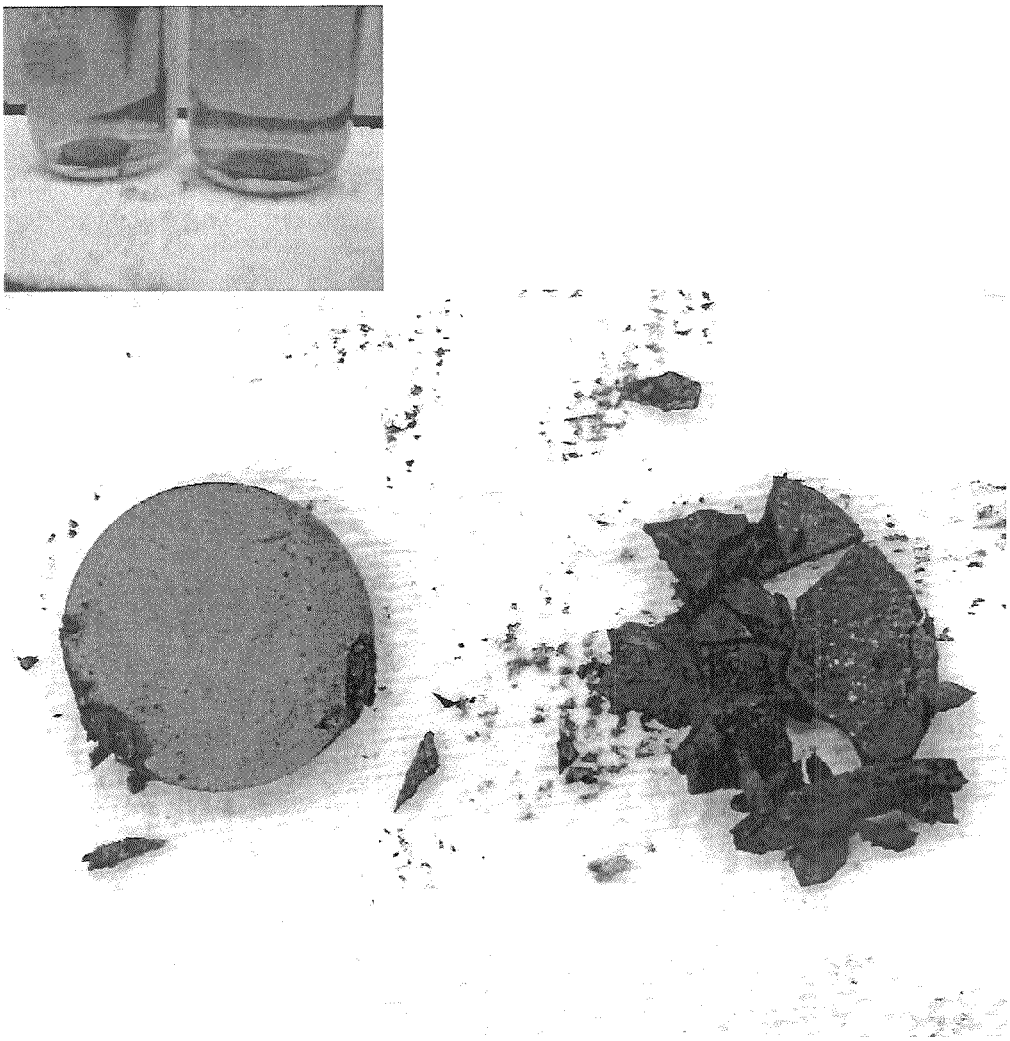
FIG. 9*a*) represents a pellet of a pressed powder of iron aluminide (left) and a pellet of a pressed powder of pure iron (right) after 54 hours of immersion in a chlorate solution.

FIG. 9*a*) represents a pellet of pressed powder of iron aluminide (left) and a pellet of pressed powder of pure iron (right) after 54 hours of immersion in a chlorate solution. The iron aluminide used in this experiment is a commercial product sold by the company Alfa Aesar whose chemical composition is: 0.021 wt % carbone, 2.24 wt % chrome, 0.50 wt % oxygen, 0.18 wt % zirconium, 0.06 wt % nickel, 80.84 wt % iron and 16.41 wt % aluminum. This figure shows that the pellet of iron aluminide has in a chlorate solution, a much better resistance to corrosion than the one of pure iron. This high corrosion resistance comes from the presence of aluminum in the structure which forms a protective layer of alumina. This corrosion resistance of the electrode materials according to the invention offers a significant advantage with respect to the iron electrodes presently used in the industry in open circuit conditions, or in other words, when the cathodic protection is no longer present.

Figure 9B:
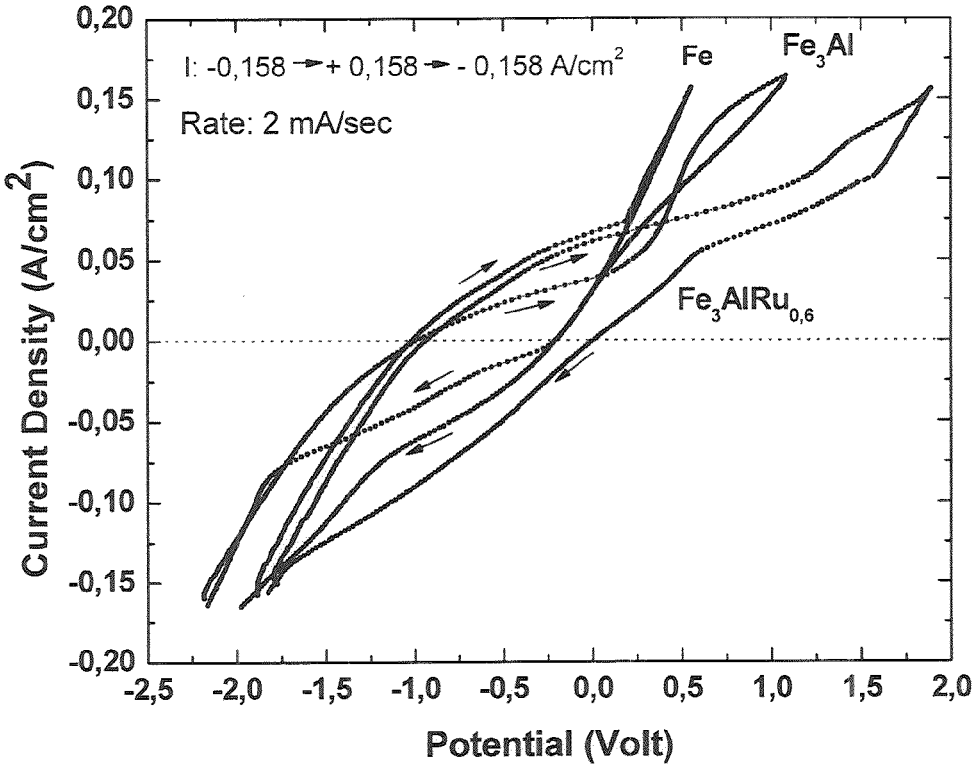
FIG. 9*b*) represents curves of "current density versus potential" of three electrodes made respectively of Fe, $Fe_3Al$ and $Fe_3AlRu_{0.6}$ when the current density is varied from −158 $mA/cm^2$ to +158 $mA/cm^2$ to −158 $mA/cm^2$ at a rate of 2 mA/sec.

FIG. 9*b*) represents curves of "current density versus potential" of three electrodes made respectively of Fe, $Fe_3Al$ and $Fe_3AlRu_{0.6}$ when the current is varied from −158 mA/cm$^2$ to +158 mA/cm$^2$ to −158 mA/cm$^2$ at a rate of 2 mA/sec. In other words, this figure shows the tolerance of an electrode according to the invention to a current reversal compared to an electrode of iron or $Fe_3Al$ without catalytic specie.

This figure shows that the electrode of formula $Fe_3AlRu_{0.6}$ according to the invention is highly resistant to oxidation. Indeed, the potential at which the oxidation of iron into $Fe_2O_3$ occurs is more and more anodic when we go from an electrode of Fe to an electrode of $Fe_3Al$ to an electrode of $Fe_3AlRu_{0.6}$.

Figure 10A:
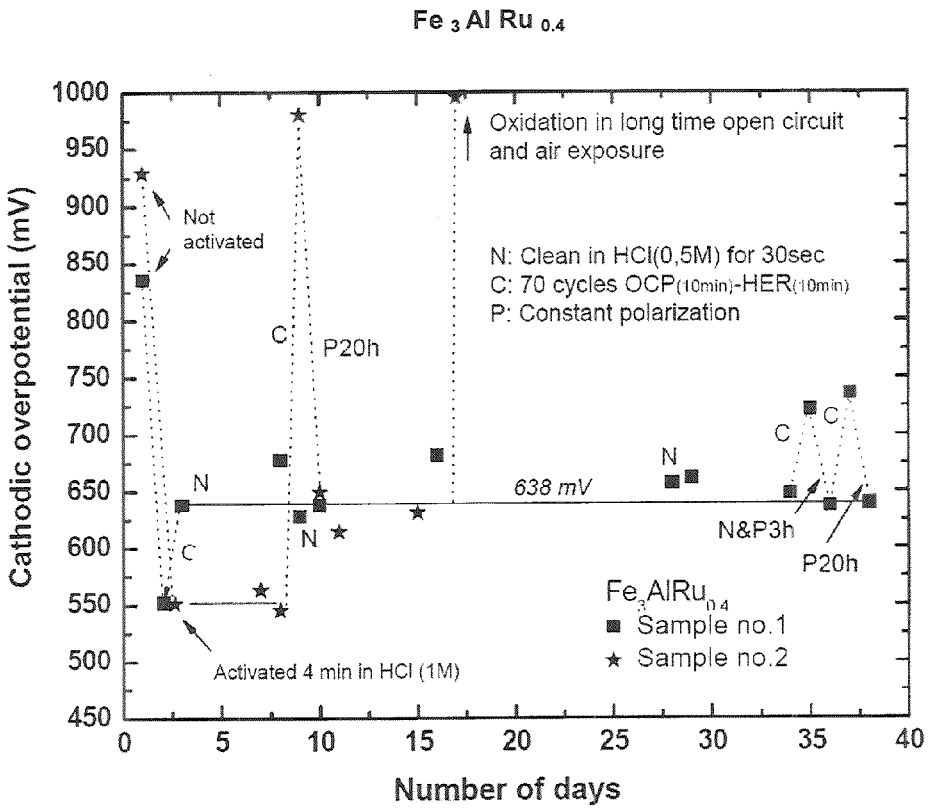
FIG. 10*a*) shows an endurance test for an electrode made of an alloy of formula $Fe_3AlRu_{0.4}$ according to the invention on a time period of nearly 40 days.
Figure 10B:
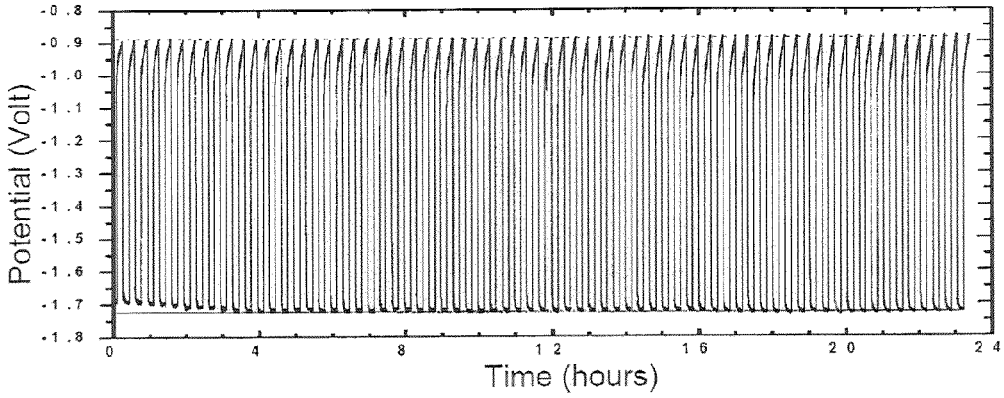
FIG. 10*b*) shows the performances of an electrode made of an alloy of formula $Fe_3AlRu_{0.4}$ according to the invention during a cycling test of 70 periods of 10 minutes in open circuit (OCP) followed by 10 minutes in short circuit (HER) at 250 $mA/cm^2$.
Figure 10C:
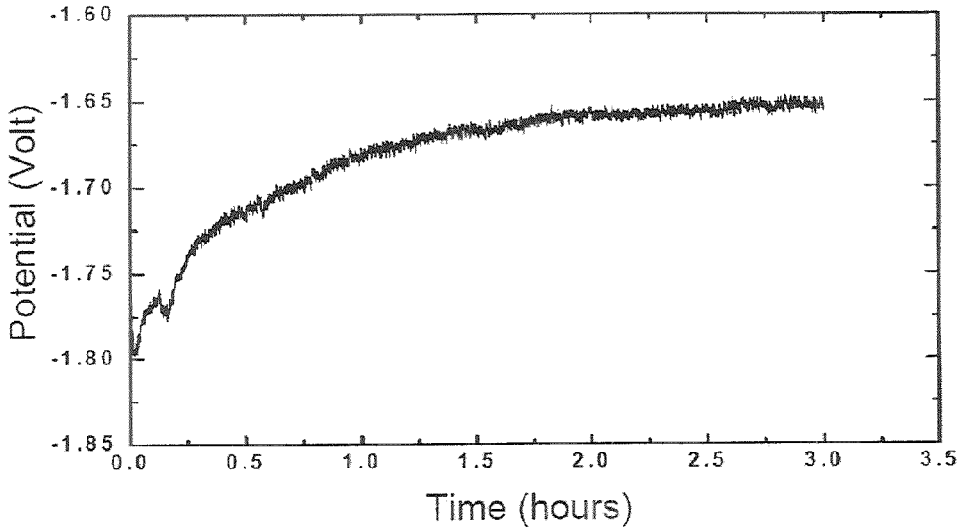
FIG. 10*c*) shows the retrieval of the performances of the potential during constant polarization at 250 $mA/cm^2$ of an electrode made of an alloy of the formula $Fe_3AlRu_{0.4}$ according to the invention after the cycling test shown in FIG. 10*b*.

FIG. 10 *a*) shows a test of endurance of an electrode of formula $Fe_3AlRu_{0.4}$ according to the invention on a period of nearly 40 days. FIG. 10 *b*) shows the performances of the same electrode of formula $Fe_3AlRu_{0.4}$ according to the invention during a cycling test of 70 periods of a duration of 10 minutes in open circuit (OCP) followed by 10 minutes in closed circuit (HER) at 250 mA/cm$^2$. This cycling test has been done on the 33$^{th}$ days of the long term test shown in FIG. 10*a*) (sample no. 1). FIG. 10*c*) shows the retrieval of the performances of the potential during constant polarization at 250 mA/cm$^2$ of this electrode of formula $Fe_3AlRu_{0.4}$ according to the invention following the cycling test shown in FIG. 4*b*). This performance retrieval after cycling has been achieved on the 35$^{th}$ days of the long term test shown in FIG. 10*a*).

FIG. 10 shows the stability of electrodes according to the invention whether in period of production (constant polarization) or shut down (open circuit) and even when there is frequent shifts between these operating conditions (production for 10 minutes followed by a stop of 10 minutes and so on).

Figure 11:
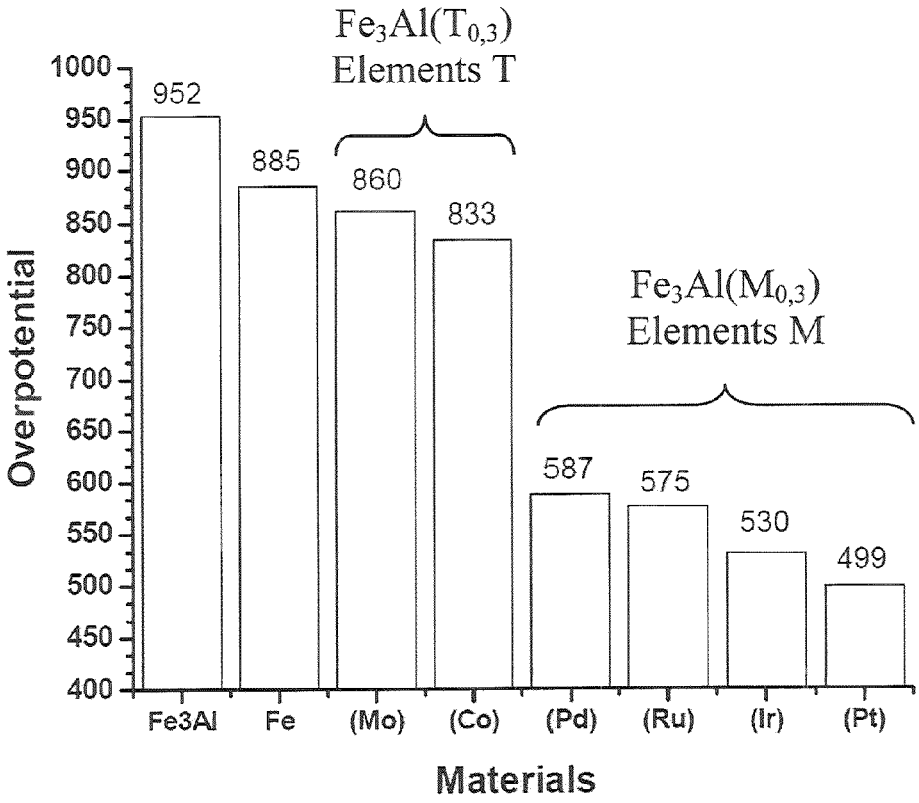
FIG. 11 shows cathodic overpotential values obtained in the case where the iron aluminide is doped with various catalytic species other than Ru (elements M) or with various non-catalytic elements (elements T).

FIG. 11 shows cathodic overpotential values obtained in the case where the iron aluminide ($Fe_3Al$) is doped with various catalytic species other than Ru (elements M) or with non-catalytic species (element T). In fact, this FIG. 11 presents the overpotential values of electrodes made of alloys according to the invention of the type $Fe_3Al(M)_{0.3}$ where M is chosen among Pd, Ru, Ir and Pt or of the type $Fe_3Al(T)_{0.3}$ where T is chosen among Mo and Co. The results reported on FIG. 11 demonstrate that it is possible to obtain good electrocatalytic performances with the insertion of catalytic species other than Ru.

Figure 12:
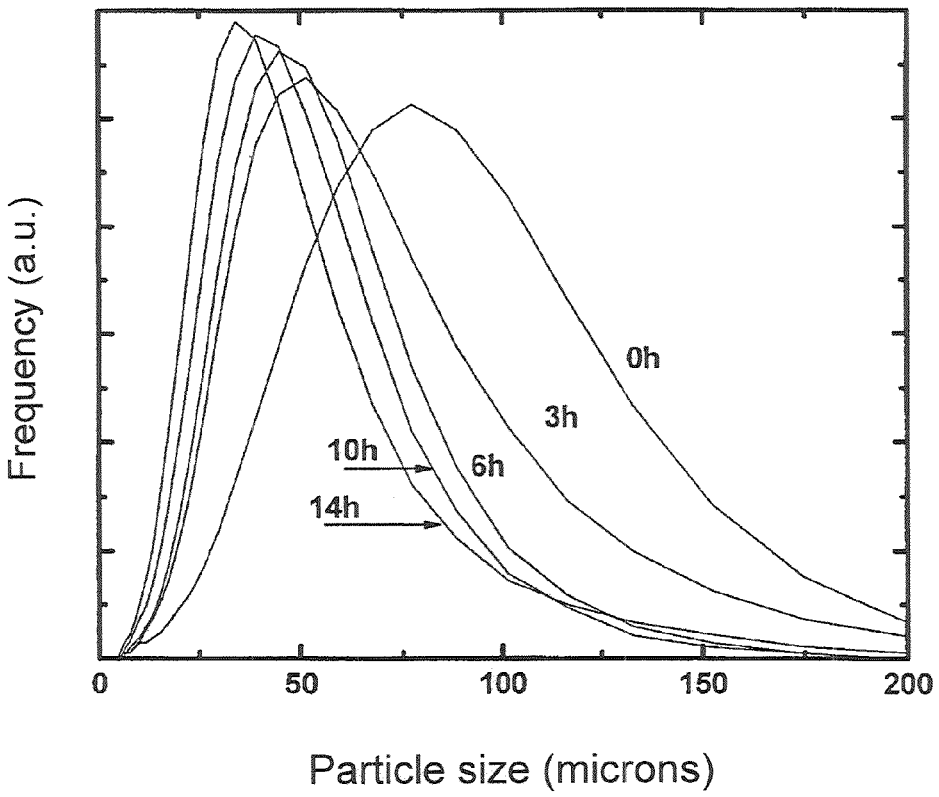
FIG. 12 shows the mean size and the powder particle distribution of $Fe_3AlRu_{0.1}$ as a function of the milling time.

FIG. 12 shows the average size and the distribution of powder particles of $Fe_3AlRu_{0.1}$ as a function of milling time. The iron aluminide used for the fabrication of $Fe_3AlRu_{0.1}$ is a commercial product sold by the company Ametek whose chemical composition is: 0.01 wt % boron, 2.29 wt % chrome, 16.05 wt % aluminum, the balance being iron. On can see on FIG. 12, that the distributions of particles of iron aluminide doped with Ru become narrower as a function of the milling time and the average size decreases with time. The initial average size is 71.2 μm and it is 37.8 μm after 14 hours of milling. At the same time that the reduction of the average size of powder particles is taking place, the size of crystallites in each of these particle is also being reduced to nanometer scale dimensions (<100 nm) by the mechanical deformations produced during the intensive milling.

At this point, It important to mention that the nanocrystalline materials according to the invention can not only be fabricated by intense mechanical milling but also by other techniques such as the rapid quenching from the liquid state. Indeed, it is possible to cool a $Fe_3Al(Ru)$ liquid mixture rapidly enough so that the ruthenium or another chosen catalytic specie, stays trapped within the crystallographic structure of the iron aluminide and the crystal size stays at the nanometer scale (<100 nm). Techniques such as the atomization, melt-spinning, splat-quenching can be used to this effect. In the same manner, it is possible to cool rapidly enough melted particles or partially melted particles of composition according to the invention by projecting them on a substrate which conduct heat in order to produce electrodes according to the invention. Deposition techniques such as APS (air plasma spray), VPS (vacuum plasma spray), LPPS (low pressure plasma spray), CS (cold spray) and HVOF (high velocity oxyfuel) can be used for this purpose.

Figure 13:
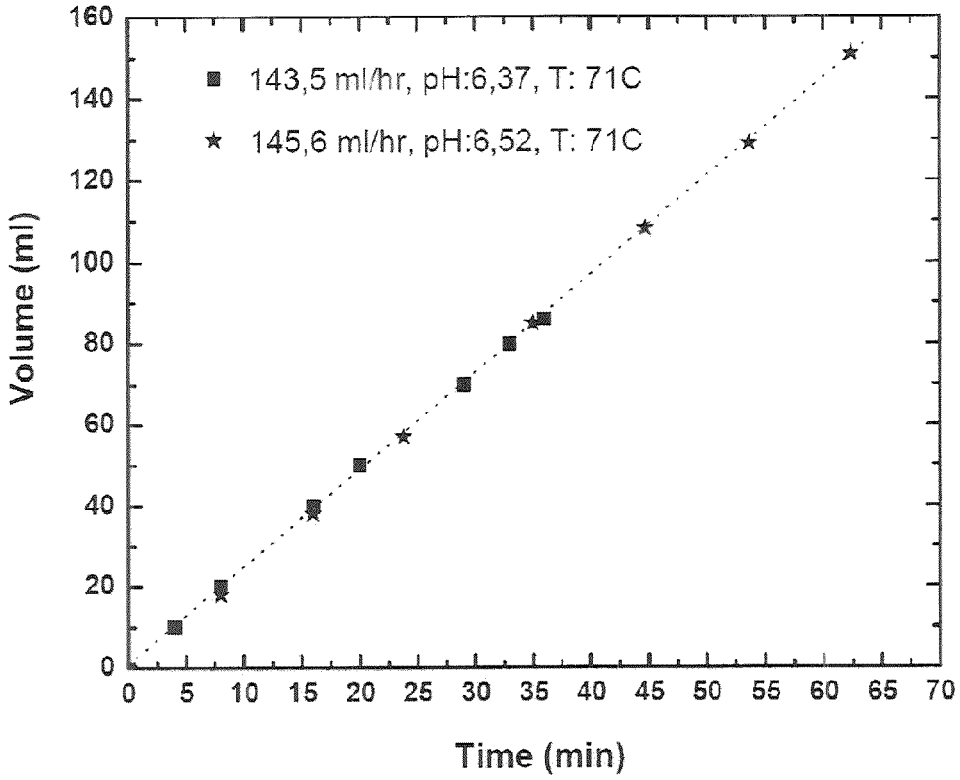
FIG. 13 shows the volume of gas released from an experimental cell containing a sample of an alloy of formula $Fe_3AlRu_{0.4}$ according to the invention due to the electrochemical reaction of synthesis of sodium chlorate at a temperature of 71° C. and at a pH of about 6.5.

FIG. 13 shows the volume of gas released by an experimental cell containing a sample of a $Fe_3AlRu_{0.4}$ alloy according to the invention due to the electrochemical reaction of synthesis of sodium chlorate at a temperature of 71° C. and at a pH of about 6.5. One notes on FIG. 13 that the rate of release of gas has been of 143.5 ml/hr in a first experiment and 145.6 ml/hr during a second experiment. According to the electrochemical reaction of synthesis of sodium chlorate indicated below:

$$NaCl+3H_2O+6\acute{e}\rightarrow NaClO_3+3H_2$$

one has a release of 3 hydrogen molecules for 6 electrons. At a current density of 250 mA/cm$^2$ and for a sample surface of 1.27 cm$^2$, the theoretical quantity of hydrogen release is of 143.3 ml/hr for a gas volume collected at 22° C. The closeness of the experimental results with the theoretical value suggests a good current efficiency of the catalytic materials according to the invention.

The invention claimed is:

1. A nanocrystalline alloy of the formula $$Fe_{3-x}Al_{1+x}M_yT_z$$

wherein:

M represents at least one catalytic species selected from the group consisting of Ru, Ir, Pd, Pt, Rh, Os, Re, and Ag;

T represents at least one element selected from the group consisting of Mo, Co, Cr, V, Cu, Zn, Nb, W, Zr, Y, Mn, Cd, Si, B, C, O, N, P, F, S, Cl and Na;

x is a number higher than −1 and smaller than or equal to +1;

y is a number higher than 0 and smaller than or equal to +1;

z is a number ranging between 0 and +1, wherein the alloy has a principal phase having a chemically disordered cubic crystallographic structure of the type $Fe_3Al(Ru)$.

2. The nanocrystalline alloy according to claim 1, wherein: x is ranging between −0.5 and +0.5.

3. The nanocrystalline alloy according to claim 2, wherein: x equals 0.

4. The nanocrystalline alloy according to claim 3, wherein: y equals 0.2.

5. The nanocrystalline alloy according to claim 4, wherein: z equals 0.

6. The nanocrystalline alloy according to claim 2, wherein: y is ranging between 0.05 and 0.06.

7. The nanocrystalline alloy according to claim 6, wherein: z is ranging between 0 and 0.5.

8. The nanocrystalline alloy according to claim 1 wherein:

M represents at least one element selected from the group consisting of Ru, Ir, and Pd; and T represents one or several elements selected from the group consisting of Mo, Co and Cr.

9. The nanocrystalline alloy according to claim 1 wherein:

M represents at least one element selected from the group consisting of Ru, Ir, and Pd;

x equals 0;

y equals 0.2; and z equals 0.

10. A method of fabrication of a nanocrystalline alloy of the formula $Fe_{3-x}Al_{1+x}M_yT_z$ as defined in claim 1 comprising a mixture of a $Fe_3Al$ powder and a powder of one or several catalytic species M and optionally a powder of one or several elements T to a mechanical intensive milling for a duration sufficient to introduce the catalytic specie or species M and the element or elements T within the crystalline structure of $Fe_3Al$ and reduce the crystal size to a nanometer scale.

11. The method of fabrication of a nanocrystalline alloy according to claim 10, wherein:

x is ranging between −0.5 and +0.5;

y is ranging between 0.05 and 0.6; and z is ranging between 0 and 0.5.

12. The method of fabrication of a nanocrystalline alloy according to claim 10, wherein:

x equals 0;

y equals 0.2; and z equals 0.

13. The method of fabrication of a nanocrystalline alloy according to claim 10, wherein:

M represents at least one element selected from the group consisting of Ru, Ir, and Pd; and T represents one or several elements selected from the group consisting of Mo, Co and Cr.

14. The method of fabrication of a nanocrystalline alloy according to claim 10, wherein:

M represents at least one element selected from the group consisting of Ru, Ir, and Pd;

x equals 0;

y equals 0.2; and z equals 0.

15. A method of fabrication of an electrode, comprising the step of applying a nanocrystalline alloy of formula $Fe_{3-x}Al_{1+x}M_yT_z$ as defined in claim 1, in the form of a powder on a substrate, by projection with one of the following techniques:

cold spray (CS); or high velocity oxyfuel (HVOF).

16. The method according to claim 15, wherein:

x is ranging between −0.5 and +0.5;

y is ranging between 0.05 and 0.6; and z is ranging between 0 and 0.5.

17. The method according to claim 15, wherein:

x equals 0;

y equals 0.2; and z equals 0.

18. The method according to claim 15, wherein:

M represents at least one element selected from the group consisting of Ru, Ir, and Pd; and T represents one or several elements selected from the group consisting of Mo, Co and Cr.

19. The method according to claim 15, wherein:

M represents at least one element selected from the group consisting of Ru, Ir, and Pd;

x equals 0;

y equals 0.2; and z equals 0.

20. The method according to claim 15, wherein the substrate is an iron or a titanium plate.

* * * * *